United States Patent [19]

Mailliet et al.

[11] Patent Number: 4,987,838

[45] Date of Patent: Jan. 29, 1991

[54] DEVICE FOR INJECTING PREHEATED AIR INTO A SHAFT FURNACE

[75] Inventors: Pierre Mailliet, Howald; Emile Lonardi, Bascharage; Georges Wahl, Lorentzweiler; Gustave Hoelpes, Mondorf-les-Bains, all of Luxembourg

[73] Assignee: Paul Wurth S.A., Luxembourg

[21] Appl. No.: 380,129

[22] Filed: Jul. 14, 1989

[30] Foreign Application Priority Data

Jul. 19, 1988 [LU] Luxembourg ..... 87283
Apr. 21, 1989 [LU] Luxembourg ..... 87505

[51] Int. Cl.[5] ..... F23L 5/00

[52] U.S. Cl. ..... 110/182.5; 122/6.6; 266/186; 432/99

[58] Field of Search ..... 110/182.5; 122/6.6; 266/186, 218, 265; 432/99, 95

[56] References Cited

U.S. PATENT DOCUMENTS 1,866,080 7/1932 Brosius .
3,166,621 1/1965 Carlson ..... 110/182.5
3,662,696 5/1972 Mahr et al. ..... 110/182.5
3,766,868 10/1973 Mahr ..... 110/182.5
4,212,253 7/1980 Voituriez et al. ..... 110/182.5

FOREIGN PATENT DOCUMENTS 35369 10/1885 Fed. Rep. of Germany .
7325087 8/1973 Fed. Rep. of Germany .
2218331 9/1982 Fed. Rep. of Germany .
3221070 8/1983 Fed. Rep. of Germany .
2039327 1/1971 France .

*Primary Examiner*—Henry C. Yuen
*Attorney, Agent, or Firm*—Fishman, Dionne & Cantor

[57] ABSTRACT

The device is composed of several separate elements consisting of at least one central tubular element connected, on one side, by means of a first ball-and-socket joint and a first compensator to a first connector supplying preheated air and on the opposite side, by means of a second ball-and-socket joint and a second compensator to a second connector. In order to reduce the length of the device, the second joint is oriented in the opposite direction to the said first joint, its center of curvature being located on the axis of the said second connector on the inside of the latter.

11 Claims, 9 Drawing Sheets

Fig. 6
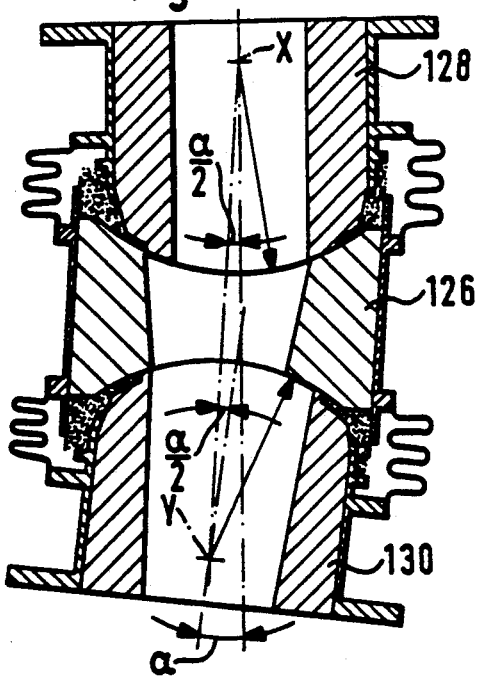
Fig. 7
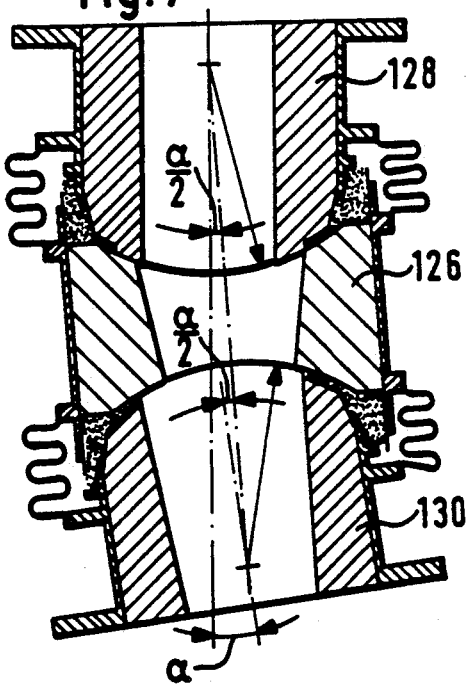
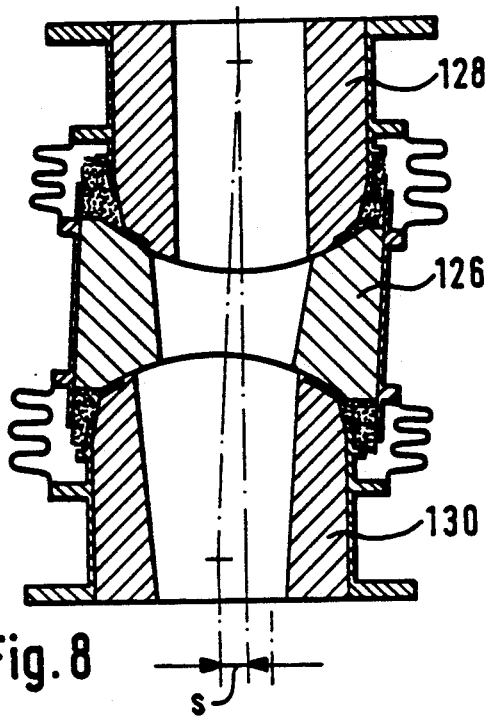
Fig. 8

DEVICE FOR INJECTING PREHEATED AIR INTO A SHAFT FURNACE

TECHNICAL FIELD

The present invention relates to shaft furnaces and more particularly to a device for injecting preheated air into a shaft furnace.

BACKGROUND

Devices for injecting preheated air into a shft furnace, known generally as "blast connections", involve problems of movability and sealing. In fact, as a result of the high temperature of the preheated air (a temperature of the order of 1,200° C. or more) and the high temperature prevailing inside the furnace, the wall of the latter as well as the circular pipeline and the blast connection are exposed to thermal expansions and deformations which cause appreciable relative shifts between the circular pipeline and the wall of the furnace. The blast connection must therefore be capable of compensating thee relative shifts, while at the same time preventing leaks of gas or preheated air.

To meet these requirements, U.S. Pat. No. 3,766,868, the disclosure of which is incorporated herein by reference, provides a blast connection of the type described above. This blast connection has since been improved by the design of universal ball-and-socket joints of the type described in the document DE-C2-2,218,331. The three joints of this blast connection make is possible to compensate all the relative movements between the circular pipeline and the wall of the furnace. Sealing in the region of the joints is obtained by means of concertina-type compensators, while mechanical stability is ensured by means of cardan connections associated with the two opposite ends of the central tubular element in the region of the first and second ball-and-socket joints.

To reduce the amount of angular shifts of the central element and thus relieve the compensators, it is desirable that the distance between the points of articulation of this element be as great as possible. On the other hand, to reduce the bulk and cost of the blast connection, it is desirable to reduce its dimensions.

SUMMARY OF THE INVENTION

An apparatus of directing preheated air from a supply pipeline to an elbow and tuyere assembly for injecting the air into a shaft furnace. The apparatus includes three refractory lined tubular elements. The first element extends along a first longitudinal axis from a first end to a convex second end. The first end is adapted for connecting to the supply pipeline and the convex second end has a first center of curvature which coincides with a point on the first axis. The second element extends along a second longitudinal axis from a convex first end to a second end. The convex first end has a second center of curvature which coincides with a point on the second axis and the second end is adapted for connecting to the elbow of the elbow and tuyere assembly. The third element extends along a third longitudinal axis for a concave first end to a concave second end. The concave first end articulates with the convex second end of the first element to form a first ball-and-socket joint. The concave second end articulates with the convex first end of the second element to form a second ball-and-socket joint. The third axis passes through the first and second centers of curvature. Means for sealing the first joint, means for sealing the second joint, and articulate means for pivotally connecting the first element to the second element are also provided.

According to one embodiment, the ties are connected to the two connectors by means of joints, the centers of which are located respectively in two diametral planes of the connectors, each containing the center of curvature of one of the said first and second ball-and-socket joints.

According to another embodiment, the end of each of the ties is connected to a flange of the said first or second connector by means of a pair of washers with spherical adjacent sliding surfaces, the center of curvature of which is located beyond the end of the tie in a diametral plane of the connector containing the center of curvature of the said first or second ball-and-socket joint.

According to an advantageous embodiment, the central tubular element is connected to the ties by means of a device for guiding and supporting the central element.

BRIEF DESCRIPTION OF THE DRAWINGS

Other particular features and characteristics of the invention will emerge from the detailed description of some advantageous embodiments given below as an illustration, with reference to the accompanying drawings in which:

FIGS. 5 through 8 show views similar to those of FIGS. 3 and 4 and illustrating the various movements of the central tubular element in relation to the adjacent connectors.

DETAILED DESCRIPTION OF THE INVENTION

Figure 1:
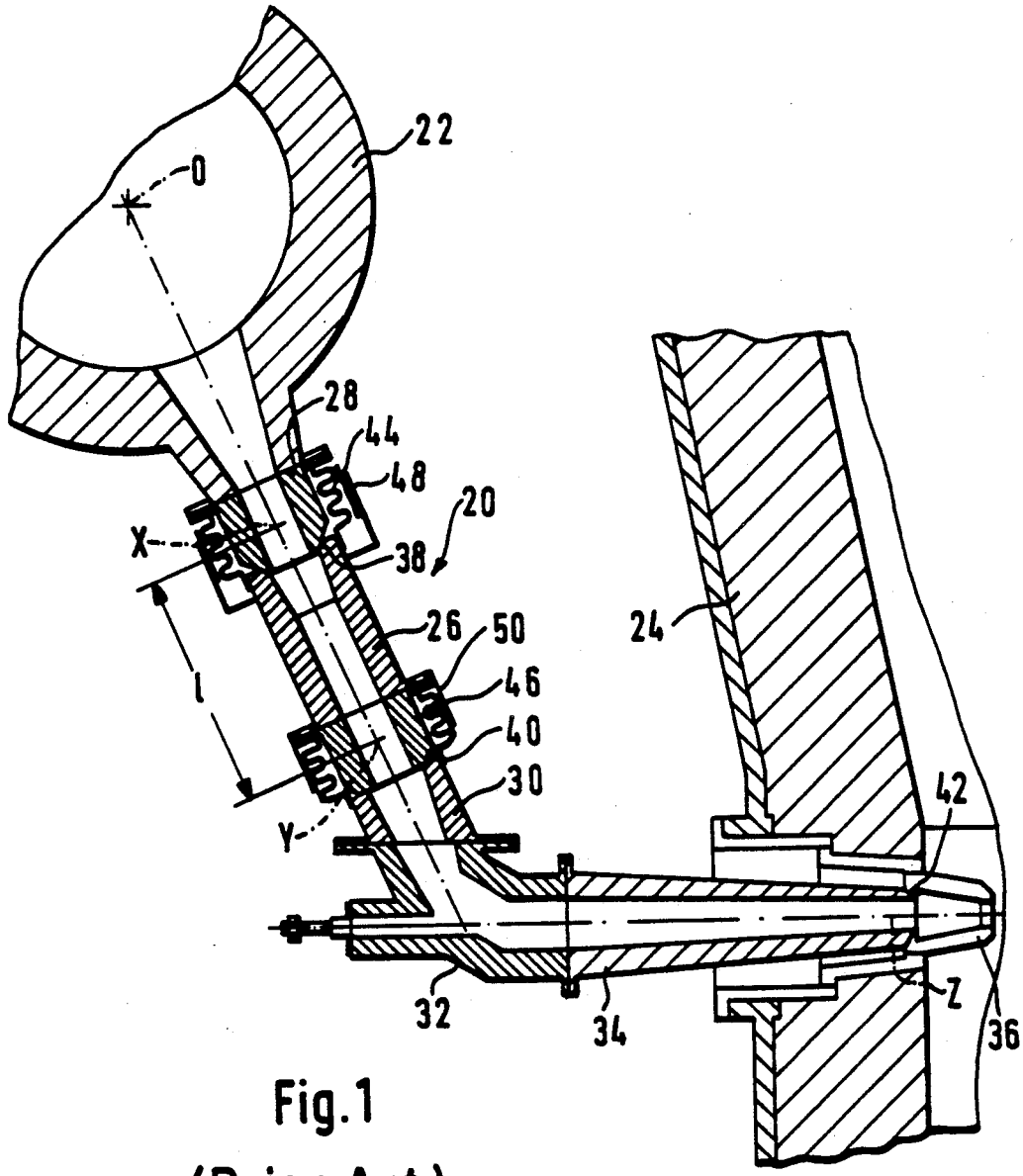
Fig.1 (Prior Art)
FIG. 1 shows a diagrammatic view, in vertical section, of a conventional blast connection according to U.S. Pat. No. 3,766,868.

The known blast connection, designated by the reference 20 in FIG. 1, connects to a main circular pipeline 2 arranged around a blast furnace to the wall 24 of the latter. This blast connection 20 comprises a straight oblique section consisting of a central tubular element 26 articulated at its upper end on a connector 28 fixed to the circular pipeline 22 and at its lower end on a connector 30 flanged to an elbow 32. This elbow 32 is extended by a tuyere 34, the end of which is articulated on a nozzle 36 fastened in the wall 24 of the furnace. The upper joint 38 and the lower joint 40 of the element 26 are ball-and-socket joints, the centers of curvature of which are identified by X and Y. Likewise, the joint between the tuyere 34 and the nozzle 36 is a ball-and-socket joint 42, the center of curvature of which is designated by Z. The three points X, Y and Z consequently form a joint with three points in space, which allows sufficient angular shifts of the tuyere 34 and of the central element 26 to compensate all the relative movements between the circular pipeline 22 and the wall 24 of the furnace.

Sealing in the region of the joints 38 and 40 is obtained by means of concertina-type compensators 44, 46 fastened respectively to the tubular element 26 and the adjacent connectors 28 and 309. Mechanical stability is ensured by means of cardan joints 48, 50 likewise connecting the central element 26 to the adjacent connectors 28 and 30. All the elements of the blast connection consist of an outer metal casing and of an inner refractory lining associated, if appropriate, with a sealing material in the region of the joints 38, 40 and 42.

The distance between the centers of curvature X and Y of the joints 38 and 40 is represented by 1 in FIG. 1. The amounts of the angular shifts of the central element 26 and consequently the stresses exerted on the compensators 44 and 46 will be the lower, the greater this distance 1. In contrast, an increase in the length 1 increases the dimensions of the blast connection.

Figure 2:
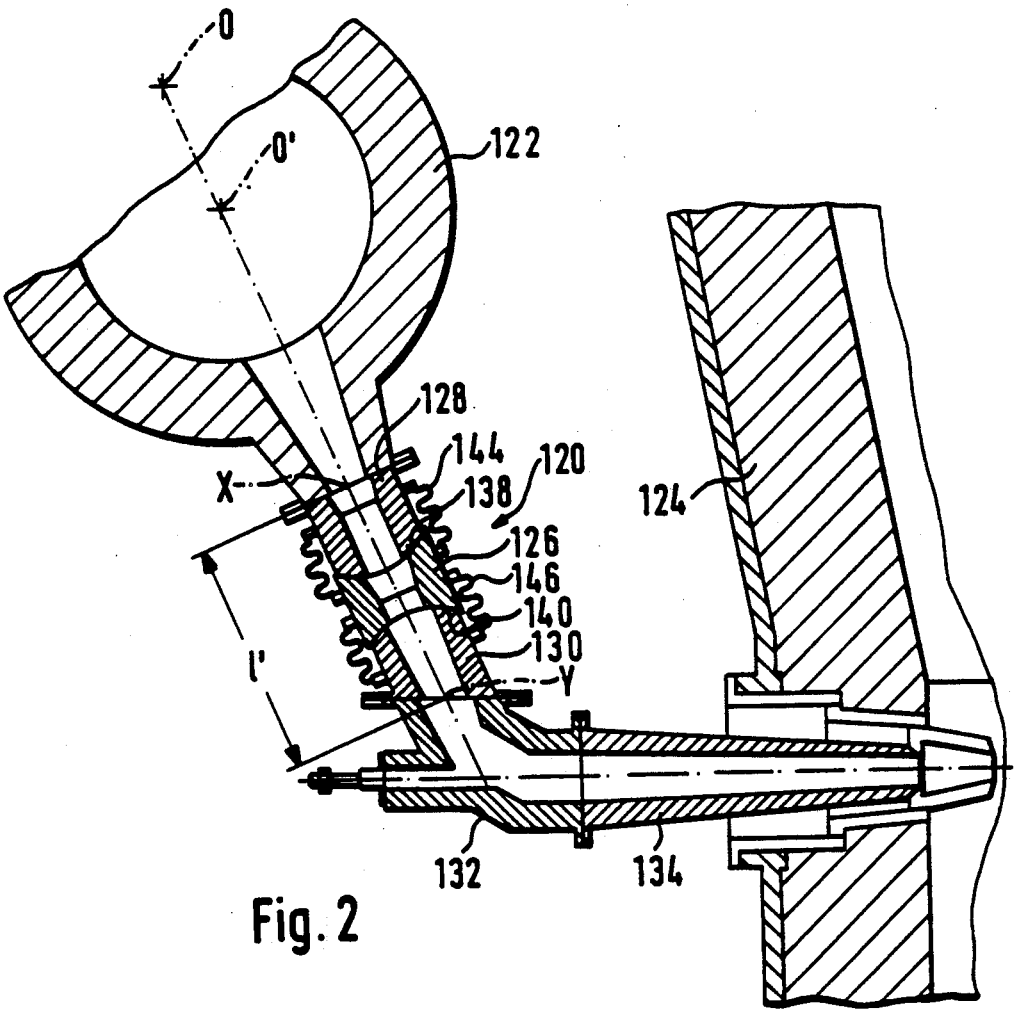
FIG. 2 shows a similar view of a blast connection according to the present invention.

According to the present invention, the lower joint of the central tubular element is reversed, so that the two upper and lower ends of this central element become concave, whereas the corresponding adjacent ends of the connectors of the circular pipeline and that of the elbow become convex. This blast connection provided by the present invention is illustrated in FIG. 2, and the elements corresponding to those of FIG. 1 bear the similar references of the series 100. As can be seen from this FIG. 2, the centers of curvatures X and Y of the ball-and-socket joints 138 and 140 are separated by a distance 1' which, in the example illustrated, is equal to the distance 1 of FIG. 1. In contrast, the total length of the central element 126 has been reduced considerably, the difference in length being illustrated by the distance between the axis O' of the circular pipeline of FIG. 2 and the location of the axis O of the blast connection of FIG. 1, likewise shown in FIG. 2. This shortening of the blast connection 120 consequently makes it possible two lower the circular pipeline 122 and bring it closer to the wall of the furnace. The result of this is, of course, a reduction in the bulk and a lowering of the production cost of the blast connection.

It would also be possible to maintain the length of the central element 26 of FIG. 1, thus making it possible to increase the distance 1 between the centers X and Y of the ball-and-socket joints 38 and 40, that is to say reduce the amount of angular shifts of this element.

Figure 3:
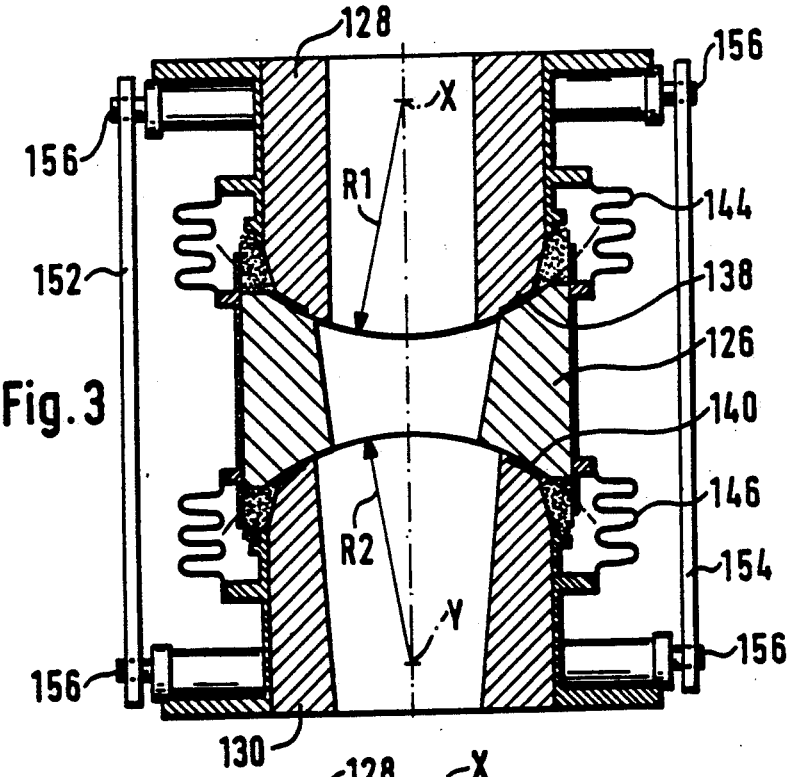
FIGS. 3 and 4 show two vertical sections, perpendicular to one another, of a first embodiment of the central part of the blast connection according to the present invention.
Figure 4:
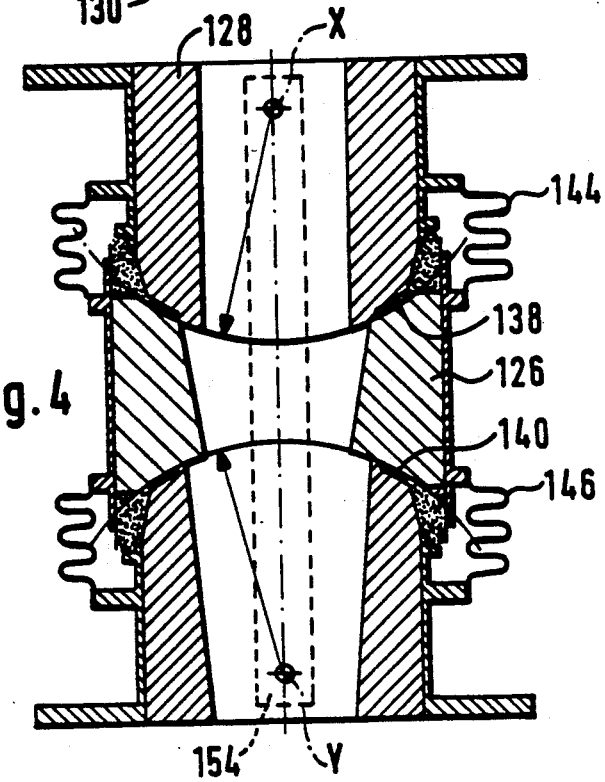

FIGS. 3 and 4 show in more detail the two joints 138 and 140 on either side of the central tubular element 126. The radii of curvature R1 and R2 of the two ball-and-socket joints 138 and 140 are preferably equal.

The present invention also propOSes to eliminate the cardan joints 48 and 50 of FIG. 1. However, because the compensators 144, 146 are not capable of supporting the weight of the blast connection, there is a pair of ties diametrically opposite one another and connecting the upper connector 128 to the lower connector 130. In the embodiment of FIGS. 3 and 4, these ties 152, 154 are simply engaged on pivots 156 integral with the connectors 128 and 130. However, to allow the necessary movability described with reference to the following FIGURES, the ties 152, 154 must be engaged on the pivots 156 with sufficient play. To allow this movability, it is also necessary for the axis of the two pivots 156 of the connector 128 to pass through the center of curvature X of the upper joint 138. Likewise, the lower pivots 156 must be fastened to the connector 130, in such a way that their axes likewise pass through the center of curvature Y of the lower joint 140.

Figure 5:
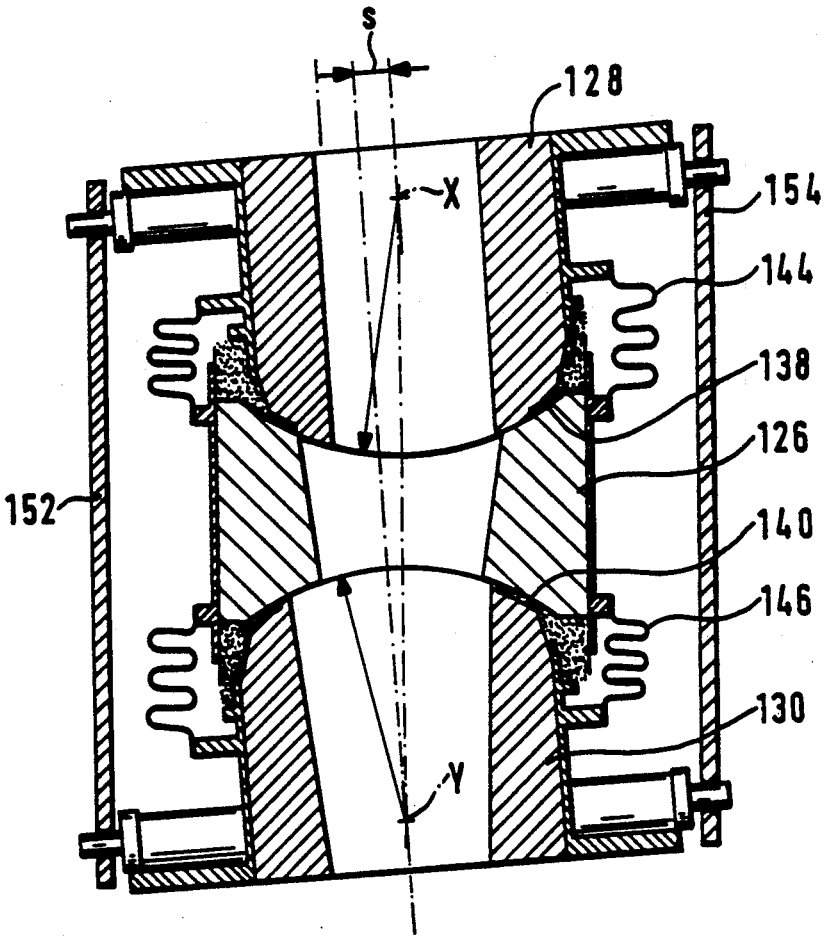

FIGS. 5 through 8 illustrate various possibilities for the movability of the blast connection. FIG. 5 illustrates, for example, a relative lateral offset of an amount S between the upper connector 128 and the lower connector 130. Such an offset can be caused, for example, by a horizontal shift of the circular pipeline 122 in relation to the furnace or a rotation of this pipeline in relation to the furnace. As shown in FIG. 5, the axes of the connectors 128 and 130 remain parallel to one another, while the central element 126 compensates this offset by positioning itself in such a way that its axis passes through the centers of curvatures X and Y of the two joints 138 and 140. This movement causes a compression of the corrugations of the compensators 144 and 146 on one side and an expansion of the corrugations of these compensators on the opposite side.

FIGS. 6 and 7 show bends respectively in one direction and in the opposite direction of the blast connection in the region of the central element 126. In both cases, the axis of the lower connector 130 is inclined at an angle relative to the axis of the upper connector 128. This bending is compensated by the central element 126 which positions itself automatically in such a way that its axis passes through the centers of curvature X and Y of the two joints, that is to say its axis forms an angle $\alpha/2$ with the axis of the upper connector 128 and an angle $\alpha/2$ with the axis of the lower connector 130. The positions of FIGS. 6 and 7 are obtained essentially as a result of a vertical relative movement between the circular pipeline 122 and the wall 124 of the furnace.

FIG. 8 shows a lateral offset between the upper and lower connectors 128 and 130 which is similar to that of FIG. 5, but is in a direction perpendicular to the movements of FIG. 5, that is to say the offset of FIG. 8 is in the plane of FIG. 2. It should be noted that FIGS. 5 through 8 show elementary movements for the sake of illustration, but in practice the movements of the blast connection are move complex, that is to say the offsets and inclinations shown in FIGS. 5 through 8 can occur at the same time.

Figure 9:
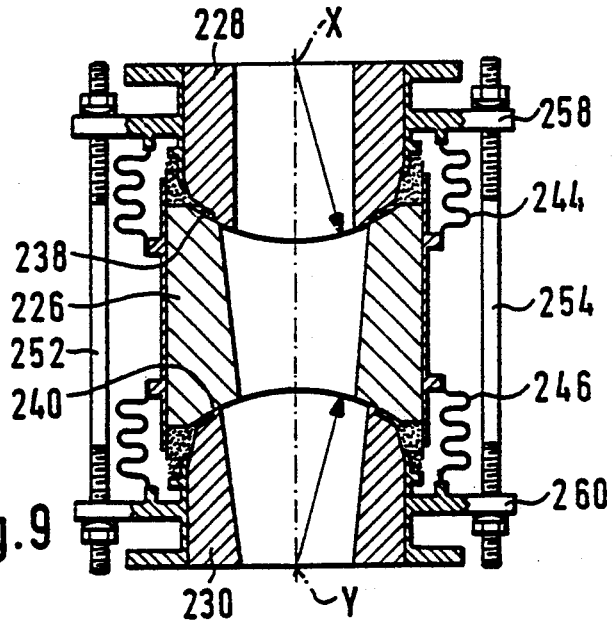
FIG. 9 illustrates a second embodiment of the central element.

FIG. 9 shows an advantageous embodiment which makes it possible to shorten the ties of the embodiment of FIG. 3. In this embodiment of FIG. 9, the two connectors 228 and 230 possess respective circular flanges 258 and 260, to which the compensators 244, 246 are attached and through which ties 252, 254 pass.

Figure 9A:
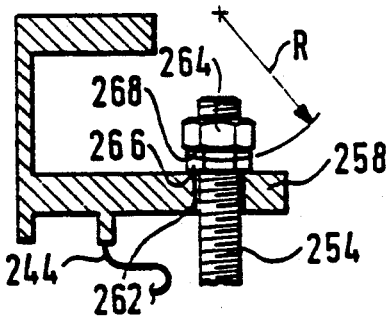
FIG. 9*a* shows an enlarged part of FIG. 9 in detail.

The connection between the ends of the ties 252, 254 and the flanges 258 and 260 is illustrated in detail in FIG. 9*a* and with reference to the connection between the tie 254 and the flange 258, the other three connections being identical to that of FIG. 9*a*. The flange 258 has a passage orifice 262 for the tie 254 which is sufficiently wide to allow some inclination of the tie 254 relative to the flange 258 as a result of movements illustrated in FIG. 5 through 8. The retention of the ties is obtained by mean of nuts 264 screwed onto the ends of the ties on the outside of the flanges 258, 260. Between each nut 264 and the corresponding flange 258 or 260 are arranged two washers 266, 268, the adjacent surfaces of which slide on one another as a result of the inclination of the tie in relation to the flange. According to the particular feature of this embodiment, the adjacent sliding surfaces of the washers 266, 268 have spherical curvatures, the center of curvature of which is located beyond the flanges 258, 260 on the axis of the ties 252, 254 or on the extension of these axes. Furthermore, the center of curvature of the washers 266, 268 must be located in a diametral plane of the connector 228 containing the center of curvature X of the ball-and-socket joint 238 between this connector 228 and the central element 226. It should be noted that the two washers 266 and 268 can be replaced respectively by a seat integral with the flange 258 and a convex surface of the nut 264.

The advantage of the design according to FIGS. 9 and 9*a* is that it is possible either to bring each of the flanges 258, 260 closer to the central element 226 by a distance R corresponding to the radius of curvature of the washers 266, 268 and reduce the length of each of the ties 252, 254 by 2R or to increase the radii of curvature of the two ball-and-socket joints 238, 240 and thus increase the distance between their centers of curvature X and Y.

FIGS. 5 through 8 showed that the compensation of the various relative movements between the upper and lower connectors is obtained by means of an alignment of the axis of the central element with the centers of curvature X and Y of the two ball-and-socket joints. In the embodiment of FIGS. 10 to 17, it is proposed to assist the ideal positioning of the central element 226 in order to avoid all random movements and superfluous friction in the region of the joints.

Figure 11:
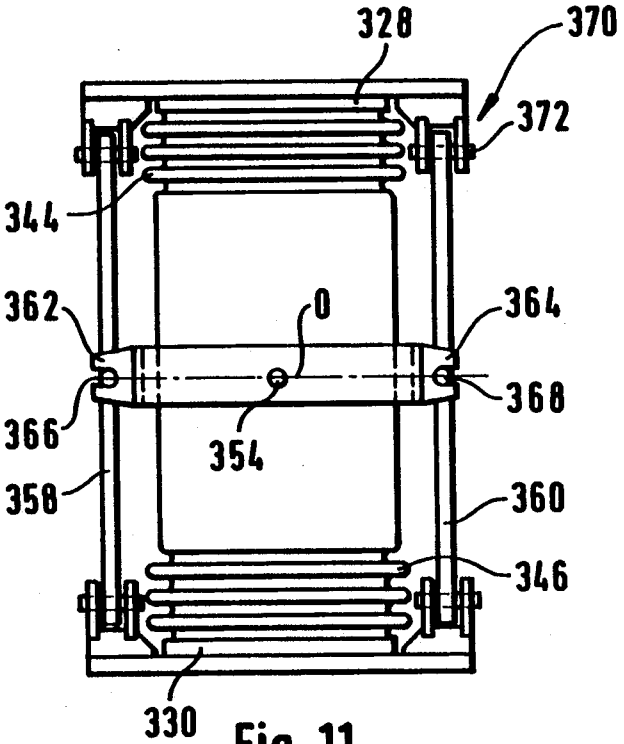
FIGS. 10 and 11 show a central part of the blast connection of a third embodiment in two directions perpendicular to one another.
Figure 10:
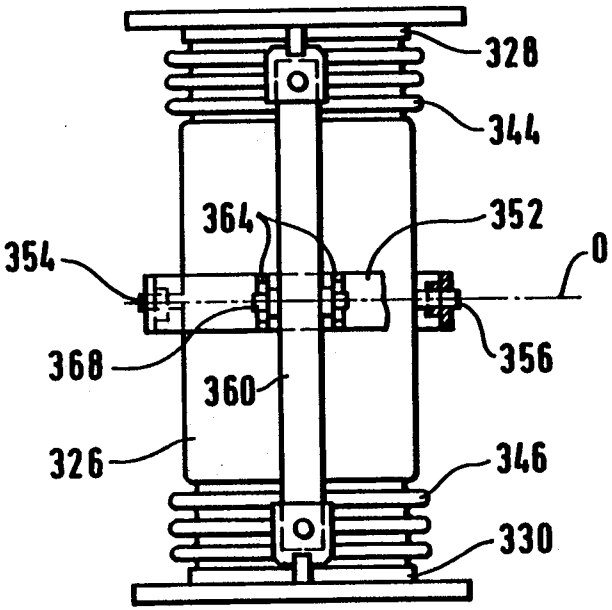

FIGS. 10 and 11 show side views of the central tubular element 326 equipped, on either side, with its compensators 344, 346 surrounding the ball-and-socket joints 338 and 340 not shown in these FIGURES.

A frame 352, for example square or preferably ring-shaped, is arranged round the central element 326, on which it is articulated by means of two diametrically opposite pivots 354 and 356, for example seated in passage orifices in the ring 352 and in the casing of the central element 326. The ring 352 can therefore execute a pivoting movement in relation to the common axis O of the two pivots 354, 356, and vice versa. The ring 352 also possesses, offset at 90° relative to the pivots 354, 356, two diametrically opposite joints connecting it to two ties 358, 360. These joints can consist, in the simplest way, of two pairs of forks 362 and 364 which are welded externally to the ring 352 and in the rounded recess of which is engaged a crosspiece 366, 368 of rounded cross-section integral with the ties 358, 360. The axes of the crosspieces 366, 368 therefore form two pivoting axes between the ring 352 on the one hand and the ties 358, 360 on the other hand, and vice versa, these two axes both being parallel to the pivoting axis O described above.

Furthermore, each of the two ties 358, 360 is articulated respectively on the upper and lower connectors 328 and 330 at its upper and lower ends. Each of these joints can consist of a simple hinge 370 comprising a pivoting hub 372 engaged through a double lug integral with the connector in question and an orifice at the end of the tie 358 or 360. The passage orifices at the ends of the ties 358, 360 are made as oblong holes and preferably have rounded bearing surfaces, in order to allow the ties 358, 360 also to pivot in the plane of FIG. 11.

The hinges 372 can also be replaced by more sophisticated joints, for example knuckles, to provide an arrangement according to FIG. 9.

The ties 358 and 360 consequently maintain a constant and predetermined distance between the connectors 328 and 330, while by means of the ring 352 they carry the central element 326 in a floating manner between the connectors 328 and 330.

FIGS. 12 through 17 illustrate various possibilities for relative movements and pivoting between the connectors 328 and 30 and how these movements are compensated by corresponding positioning of the central element 326.

Figure 14:
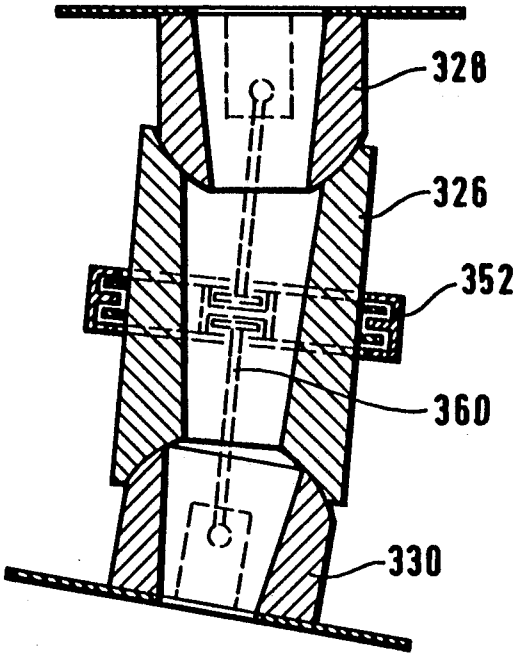
FIG. 14 shows a view similar to that of FIG. 10 in respect of an inclination of the lower connector in relation to the upper connector.
Figure 13:
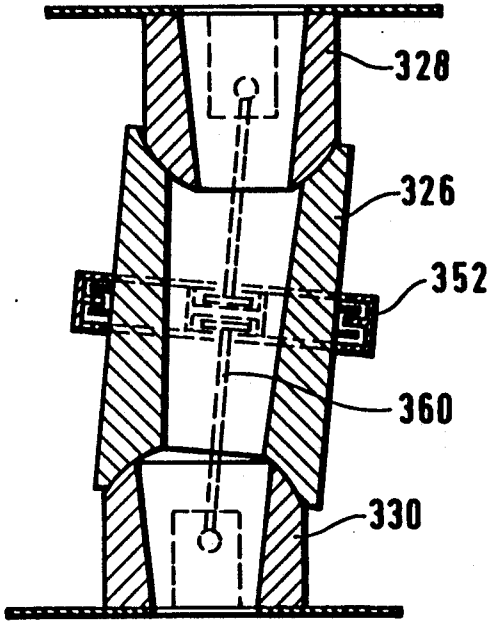
FIG. 13 is a view similar to that of FIG. 10, showing an offset of the upper and lower connectors.
Figure 12:
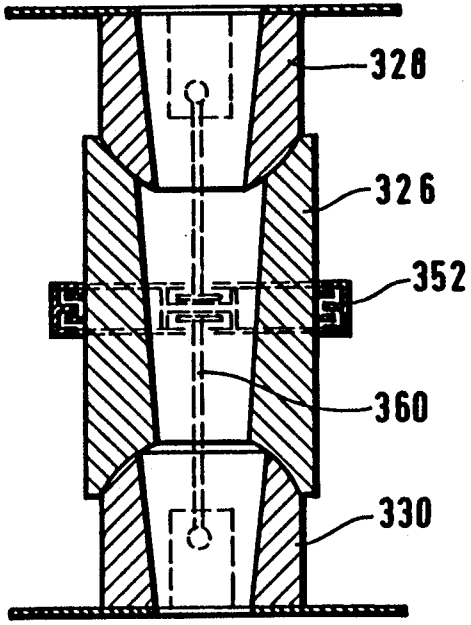
FIG. 12 is a diagrammatic sectional view corresponding to that of FIG. 10.

The relative movements and pivoting between the connectors 328 and 330 which are illustrated in FIGS. 12 through 14 subject to stress only those joints in the region of the hinges 372 between the ties 358 and 360 and the connectors, whereas the joints in the region of the ring 352 are not subjected to stress, because, as shown in FIGS. 12 and 13, the latter preserves its neutral diametral position of FIG. 10 in relation to the ties and to the central element 326.

Figure 17:
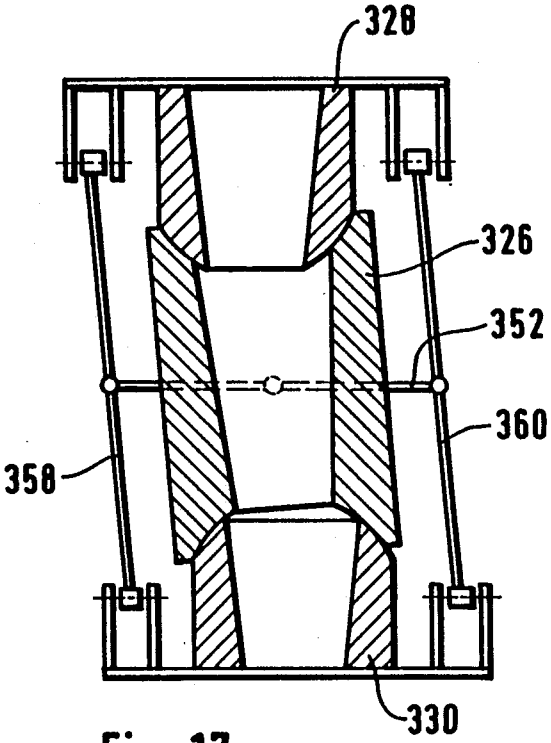
FIGS. 15 through 17 show diagrammatic sectional views corresponding to that of FIG. 11 and respectively illustrating the various sections in alignment and offset.
Figure 16:
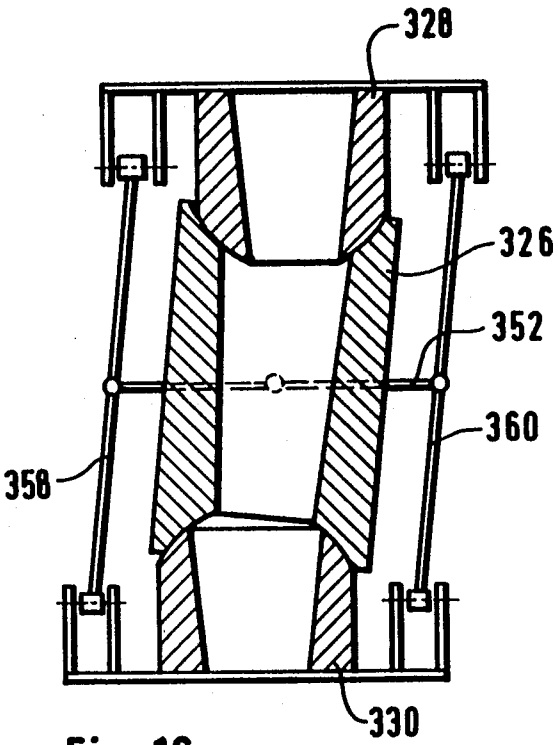
Figure 15:
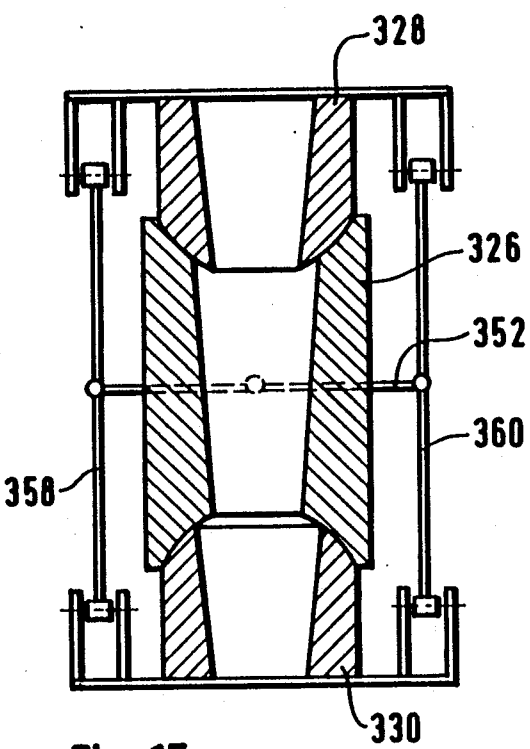

In contrast, the transverse deformations in relation to the plane of FIGS. 12 through 14 and illustrated in FIGS. 15 through 17 subject the joints in the region of the ring 352 to stress. As shown more particularly in FIGS. 16 and 17, the shifts in this plane cause a parallel deformation between the ties 358, 360 and the rings 352 as a result of the pivoting of the latter about the axis O in relation to the central element 326 and as a result of the relative pivoting between the ring 352 and the ties 358, 360.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for directing preheated air from a supply pipeline to an elbow and tuyere assembly for injecting the air into a shaft furnace, comprising:

a refractory lined first tubular element extending along a first longitudinal axis from a first end to a convex second end having a first center of curvature which coincides with a point on the first axis;

a refractory lined second tubular element extending along a second longitudinal axis from a convex first end to a second end, said convex first end having a second center of curvature which coincides with a point on the second axis and said second end being adapted for connecting to the elbow of the elbow and tuyere assembly;

a refractory lined third tubular element extending along a third longitudinal axis from a concave first end to a concave second end, said concave first end articulating with the convex second end of the first element to form a first ball-and-socket joint and said concave second end articulating with the convex first end of the second elbow to form a second ball-and-socket joint so that the third axis passes through the first and second centers of curvature;

first sealing means for sealing the first ball-and-socket joint;

second sealing means for sealing the second ball-and-socket joint; and articulated means for pivotably connecting the first element to the second element.

2. The apparatus of claim 1, wherein the first tubular element has a first inner diameter and the first inner diameter and the first center of curvature define a first diametral plane;

the second tubular element has a second inner diameter and the second inner diameter and the second center of curvature define a second diametral plane and wherein in the articulated means comprises;

a pair of ties, each of said ties extending along a longitudinal axis from a first end to a second end;

a pair of articulated joints connecting the first end of each tie to the first element, said joints being diametrically opposed across the first diametral plane;

a pair of second articulated joints connecting the second end of each tie to the second element, said second joints being diametrically opposed across the second diametral plane.

3. The apparatus of claim 2, further comprising:

support means for supporting the third element, said support means connecting the third element to each of the ties.

4. The apparatus of claim 3, wherein the support means comprises:

a frame surrounding the third element;

second articulated means for pivotally connecting the frame to the third element; and third articulated means for pivotably connecting the frame to each of the ties.

5. The apparatus of claim 4, wherein the frame is ring shaped.

6. The apparatus of claim 4, wherein the second and third articulated means allow pivotal movement about three axes, said axes each being perpendicular to a plane defined by the longitudinal axes of the ties.

7. The apparatus of claim 4, wherein the third articulated means comprises a pair of cross members, each cross member being pivotably connected to the frame and each cross member being pivotably connected to each tie.

8. The apparatus of claim 1, wherein the first element further comprises a first flange surrounding the first end of the first element and the second element further comprises a second flange surrounding the second end and the second element, each of said flanges having a pair of diametrically opposed axial holes through the flange, and said flanges being disposed so that the axial holes through the first flange are axially aligned with axial holes through the second flange and the articulated means comprises:

a pair of ties, each of said ties extending from a first end through one of the axial holes in the first flange and through the aligned axial hole in the second flange to a second end;

means for pivotally fastening the first end of each tie to the first flange; and means for pivotably fastening the second end of each ties to the second flange.

9. The apparatus of claim 8, wherein the first and second means for fastening comprise washers, each washer having a spherical sliding surface and each washer being disposed between one of the flanges and one of the end of the ties so that the sliding surface is disposed against the flange.

10. The apparatus of claim 9, wherein the first tubular element has a first inner diameter and the inner diameter and the first center of curvature define a first diametral plane;

the second tubular element has an inner diameter and the second inner diameter and the second center of curvature define a second diametral plane and wherein the washers each have a center of curvature and the center of curvature of each of the washers aligned against the first flange lies in the first diametral plane and the center of curvature of each of the washers disposed against the second flange lies in the second diametral plane.

11. The apparatus of claim 8, wherein each of the ties have threaded portions near the first and second end of the ties and the first and second means for fastening comprise nuts engaging the threaded portions of the ties, said nuts each having a convex surface and each nut being disposed between one of the flanges and one of the ends of the tie so that the convex surface of the nut is disposed against the flange.

* * * * *